US006053592A

United States Patent [19]

Sutterlütti

[11] Patent Number: 6,053,592

[45] **Date of Patent: *Apr. 25, 2000**

[54] DRAWER FRAME

[75] Inventor: Harald Sutterlütti, Fussach, Austria

[73] Assignee: Julius Blum Gesellschaft M.B.H., Höchst, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 09/106,047

[22] Filed: Jun. 29, 1998

[30] Foreign Application Priority Data

Jul. 3, 1997 [AT] Austria ..... 1144/97

[51] Int. Cl.[7] ..... A47B 88/00

[52] U.S. Cl. ..... 312/330.1; 312/348.1

[58] Field of Search ..... 312/348.2, 263, 312/348.1, 348.4, 330.1; 403/407.1, 409.1, 321, 322, 231

[56] References Cited

U.S. PATENT DOCUMENTS

| | | | |
|---|---|---|---|
| 5,147,123 | 9/1992 | Berger | 312/348.1 |
| 5,172,971 | 12/1992 | Albiez | 312/348.1 |
| 5,462,349 | 10/1995 | Grabher | 312/348.1 |
| 5,538,339 | 7/1996 | Rock et al. | 312/348.2 X |
| 5,556,183 | 9/1996 | Brustle et al. | 312/348.1 |
| 5,681,101 | 10/1997 | Peter | 312/348.2 X |

FOREIGN PATENT DOCUMENTS

| | | | |
|---|---|---|---|
| 0 429 428 | 5/1991 | European Pat. Off. . | |
| 626144 | 11/1994 | European Pat. Off. | 312/330.1 |
| 2702217 | 7/1978 | Germany | 312/348.1 |
| 3805669 | 9/1988 | Germany . | |
| 3911353 | 10/1990 | Germany | 312/348.1 |
| 4011815 | 10/1991 | Germany | 312/330.1 |
| 93 03 903 | 5/1994 | Germany . | |

*Primary Examiner*—Peter M. Cuomo
*Assistant Examiner*—James O. Hansen
*Attorney, Agent, or Firm*—Wenderoth, Lind & Ponack, L.L.P.

[57] ABSTRACT

A drawer frame or drawer rail of metal has a horizontal support web for a bottom board of a wood material or plastic. A plurality of tabs having upwardly directed claws are pushed out of the horizontal support web. The claws are each arranged at the side of the tabs and the tabs are oriented in the longitudinal direction of the support web. Each tab is provided with only one claw.

16 Claims, 11 Drawing Sheets

DRAWER FRAME

BACKGROUND OF THE INVENTION

1. Field of the Invention

The invention relates to a drawer frame or drawer rail of metal having a horizontal support web for a bottom board and having a plurality of tabs which are oriented in the longitudinal direction of the support web and have upwardly directed claws punched out of the horizontal support web.

2. Description of the Prior Art

EP 0 429 428 A2 discloses a metal drawer frame which has a support web for a bottom board, out of which support web tabs provided with lateral teeth are bent. In the mounted position, the tabs project into a groove provided at the underside of the bottom board and are oriented parallel to the drawer frame. German Utility model 93 03 903 discloses a drawer having metal drawer frames which again each have a support web for a bottom board. Tabs having upwardly directed claws at their free ends are punched out of the support webs. In the mounted position, the claws are pressed into the wood material of the bottom board.

In the arrangement according to EP 0 429 428 A2, the bottom board must have two grooves at its underside for connection to the drawer frames. In the arrangement according to German Utility Model 93 03 903, there must not be any groove present in the bottom board, since otherwise engagement with the tabs of the drawer frames would not be possible.

SUMMARY OF THE INVENTION

The object of the invention is to provide a drawer frame or drawer rail which can be engaged with, or connected to, both a bottom board having grooves provided at the underside and a bottom board without grooves.

The object according to the invention is achieved in that each of the upwardly directed claws is arranged at the side of the respective tabs and likewise is oriented in the longitudinal direction of the support web.

A drawer provided with the drawer frames or drawer rails according to the invention is characterized in that the regions, engaged with the bottom board, of the tabs having the claws oriented in the longitudinal direction of the grooves are engaged in a side wall of the grooves. The anchoring of the bottom board is improved, in an exemplary embodiment of the invention, in that the tabs are provided, at the side located opposite the claw, with at least one laterally protruding tooth. Advantageously, provision is made for the tabs to be bent out of asymmetric, closed slots of the support web. The connection between the tabs, that is to say the claws, and the bottom board is improved, according to a further exemplary embodiment of the invention, in that each tab has in the region of the claw a bend or bent edge oriented perpendicularly to the claws. In order to prevent displacement of the bottom board relative to the drawer frames, for example when a drawer is pushed into the carcass of an article of furniture with too much force, provision is made in a further embodiment of the invention for each tab to have a wider region having shoulders on which further claws are formed. In this case, the tabs are punched out of the support web of the drawer frame in such a way that successive of the tabs point in opposite directions. In order for the claws formed on the shoulders of the wider regions of the tabs to be able to take up shearing forces of the bottom board well, provision is advantageously made for these claws to be formed obliquely or transversely to the orientation of the tabs.

DESCRIPTION OF THE DRAWINGS

Embodiments of the invention are described below with reference to the accompanying drawings, wherein.

Figure 1A:
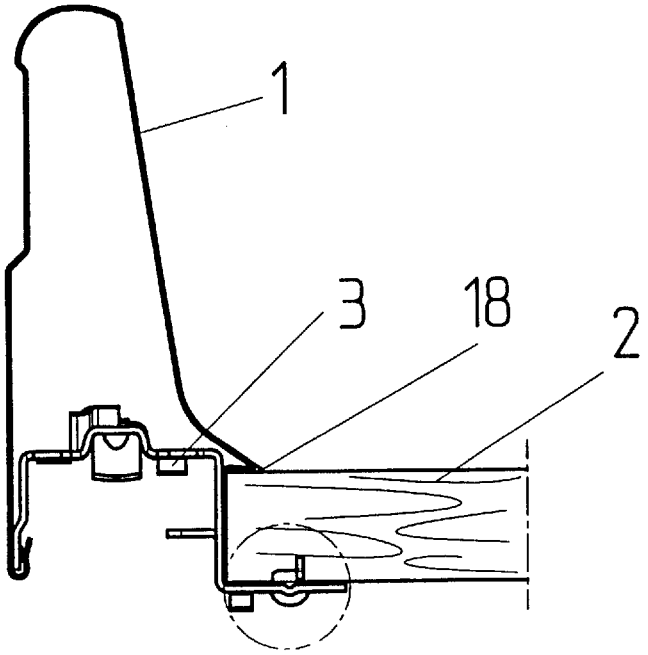
FIGS. 1*a* and 1*b* are a front view of a drawer frame and an enlarged vertical section through a bottom board, respectively.
Figure 1B:
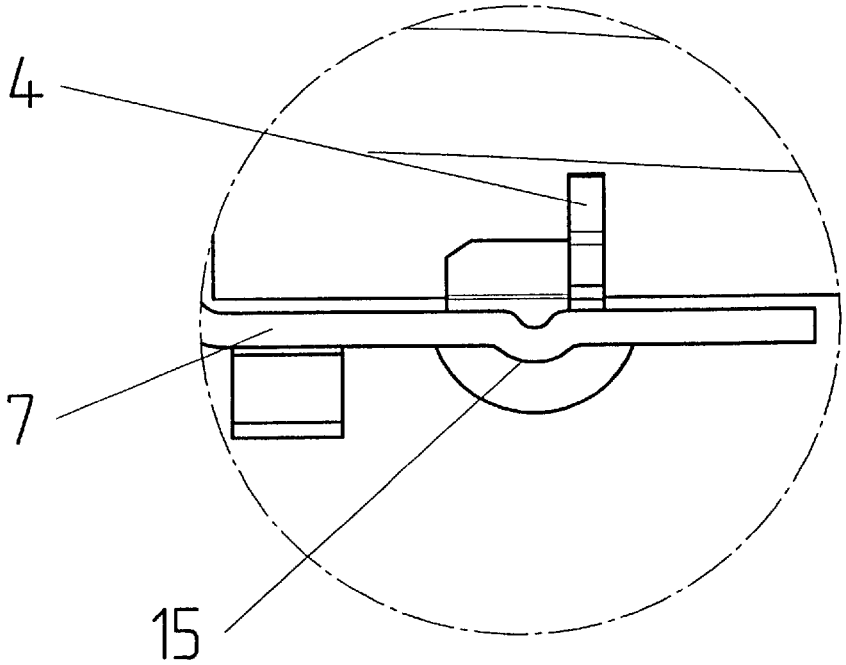
Figure 2B:
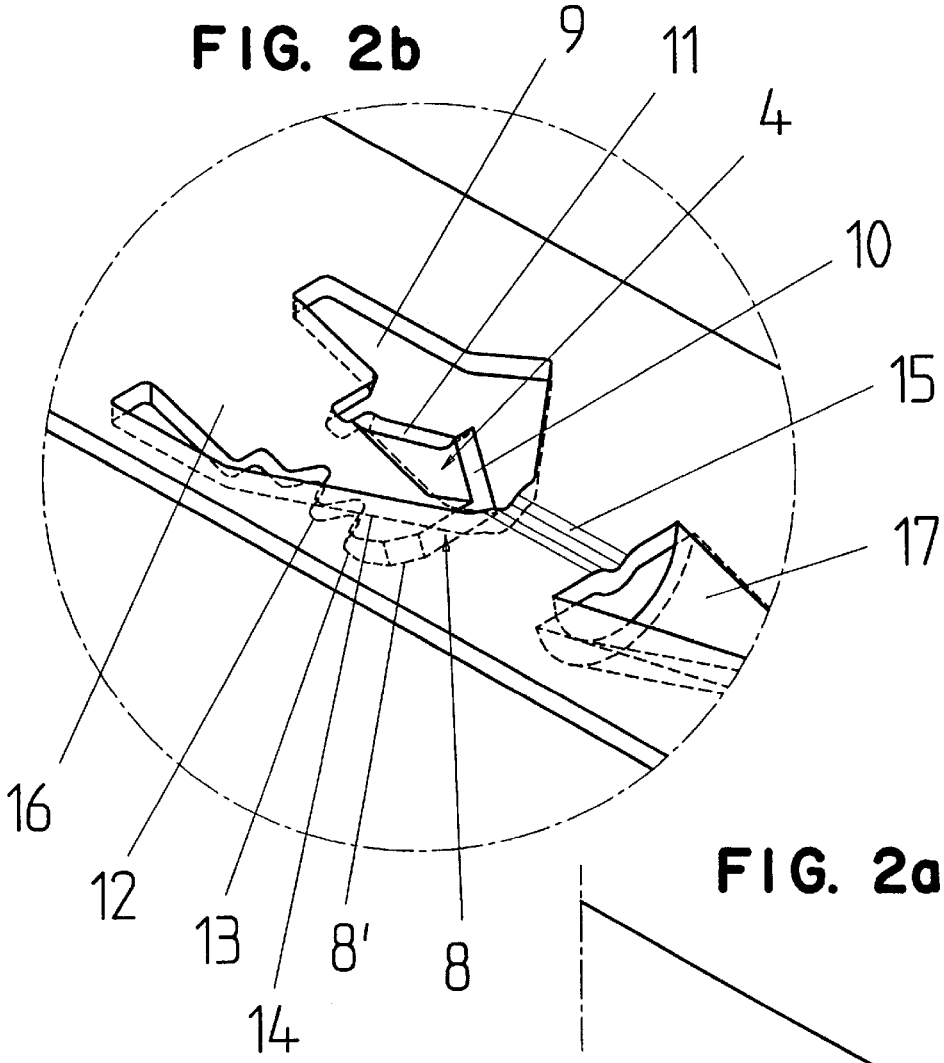
FIGS. 2*a* and 2*b* are a perspective view of a front end of a drawer frame and an enlarged detail thereof, respectively.
Figure 2A:
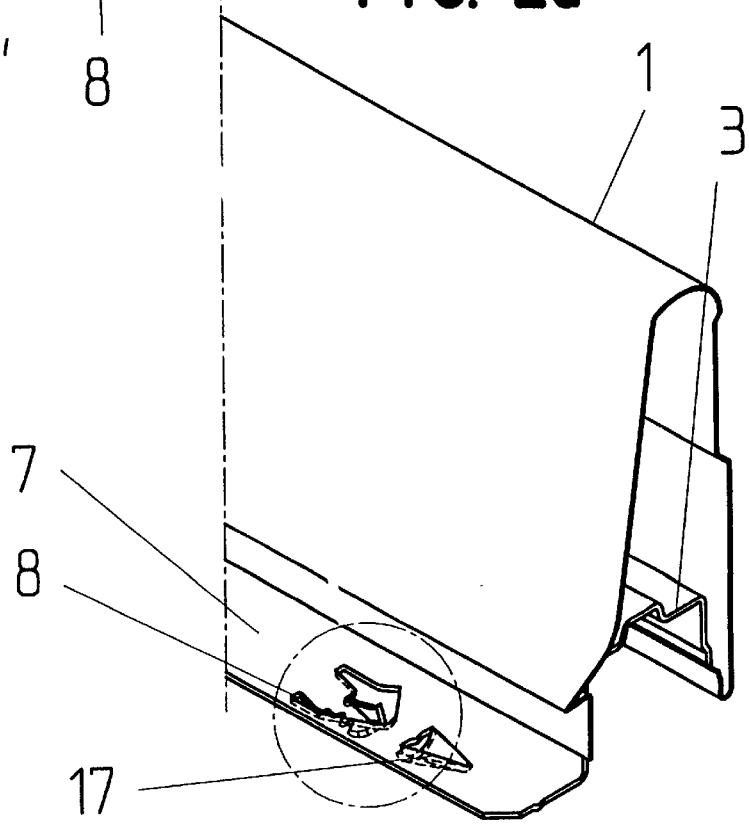
Figure 3A:
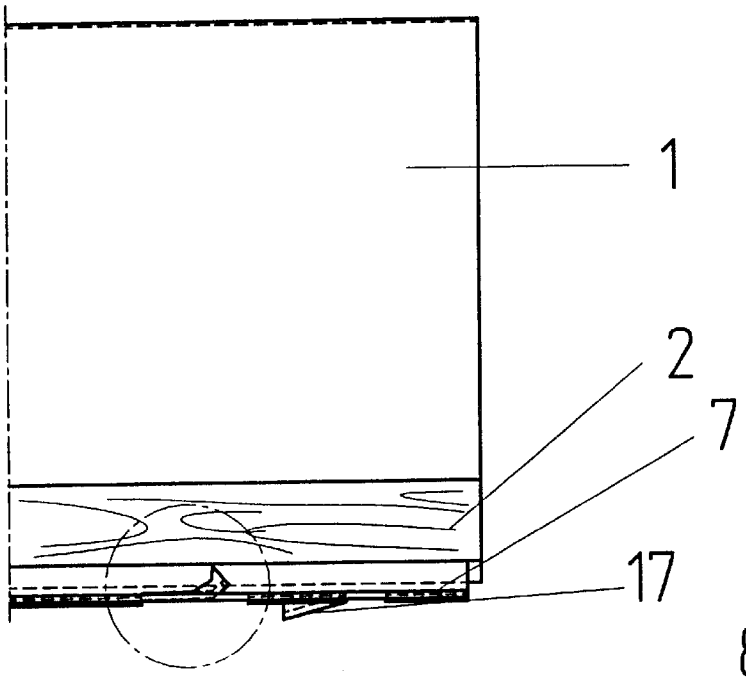
FIGS. 3*a* and 3*b* are a side view of the drawer frame the inside thereof and an enlarged detail thereof, respectively.
Figure 3B:
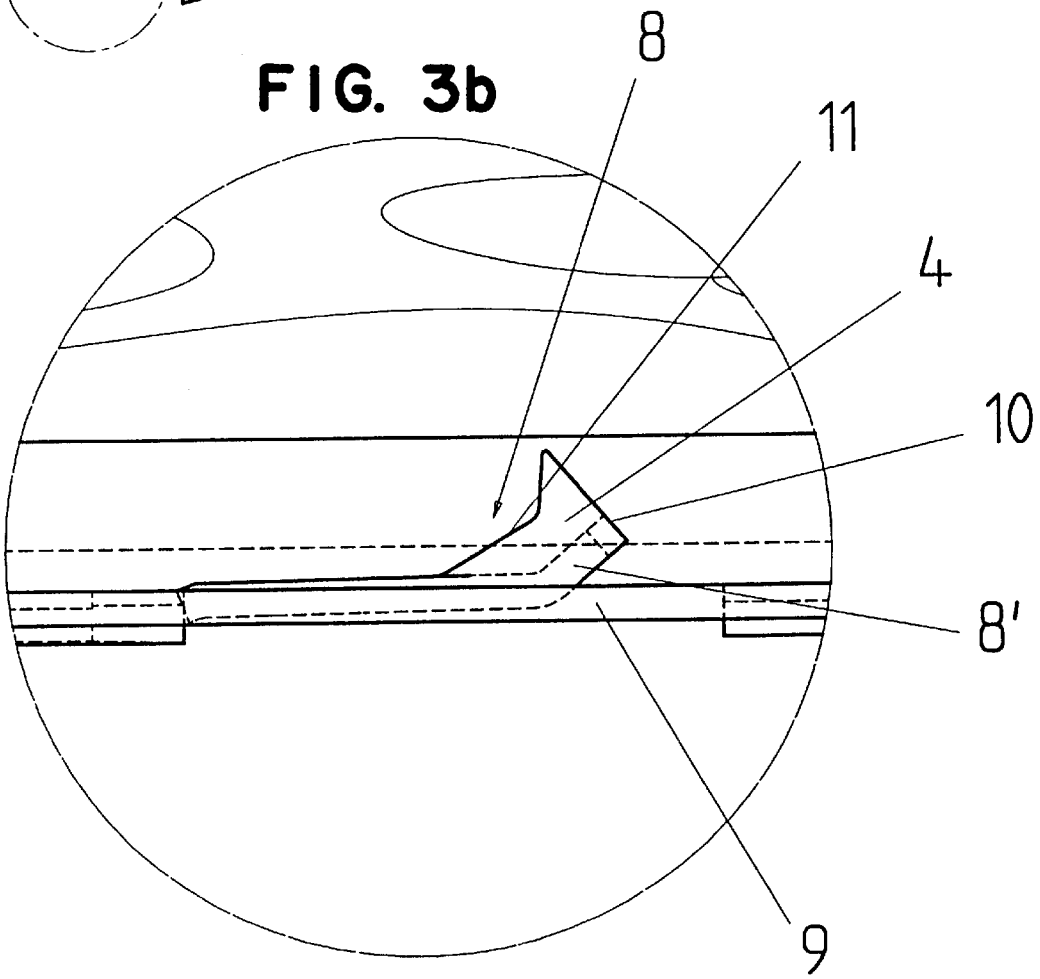
Figure 4A:
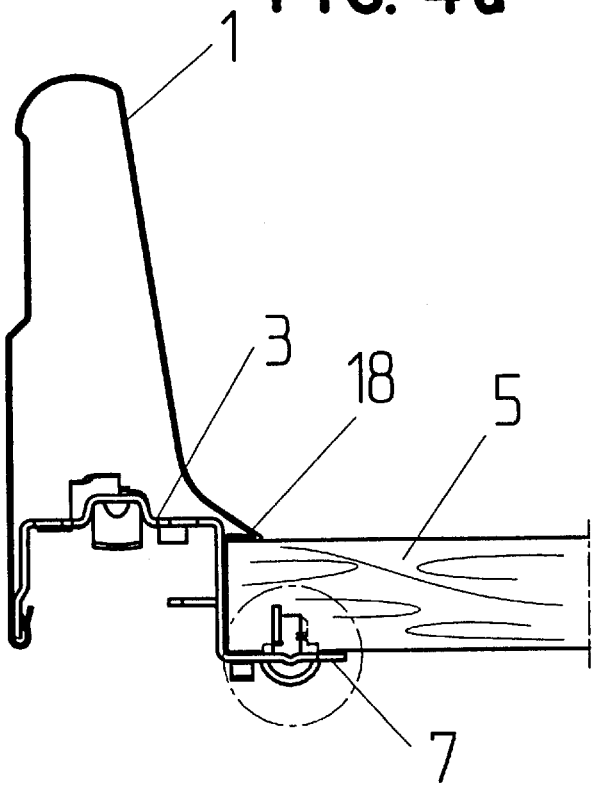
FIGS. 4*a* and 4*b* are a front view of a drawer frame and a bottom board and an enlarged detail thereof, respectively.
Figure 4B:
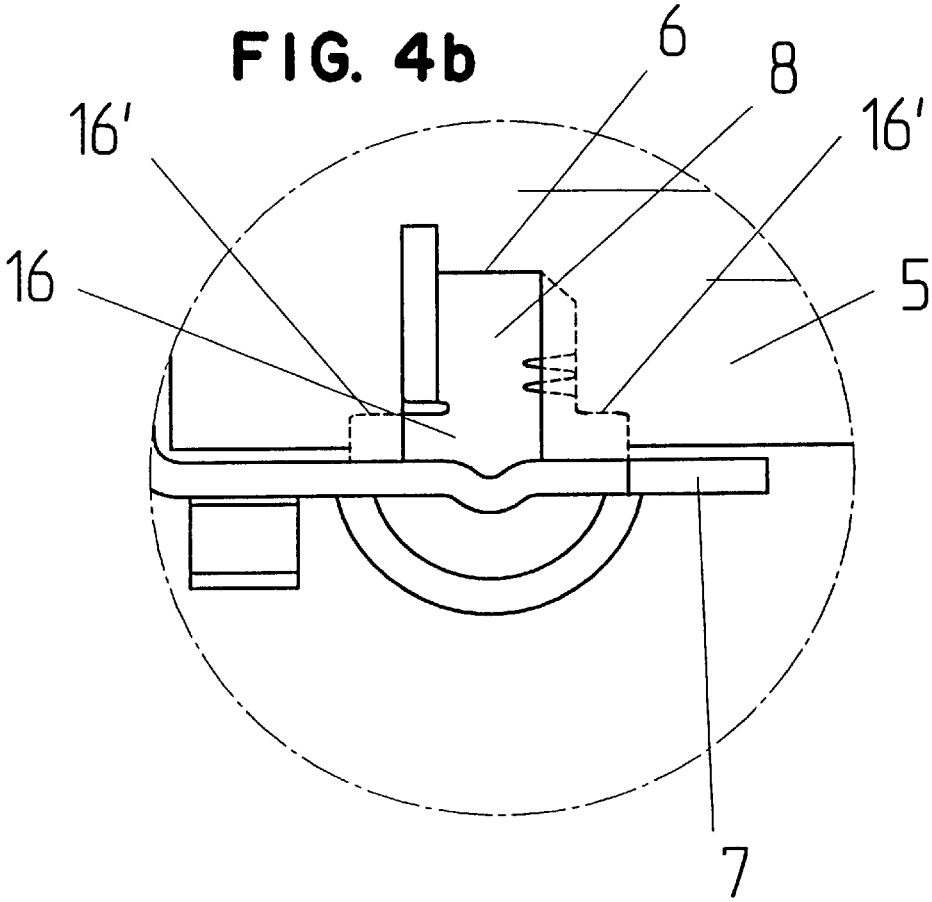
Figure 5A:
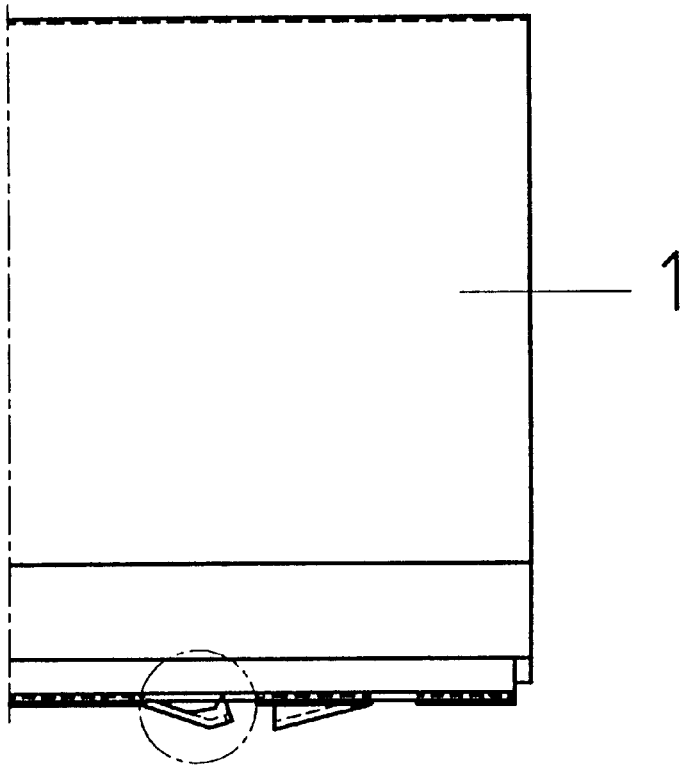
FIGS. 5*a* and 5*b* are a side view of the front end of the drawer frame and an enlarged detail thereof, respectively.
Figure 5B:
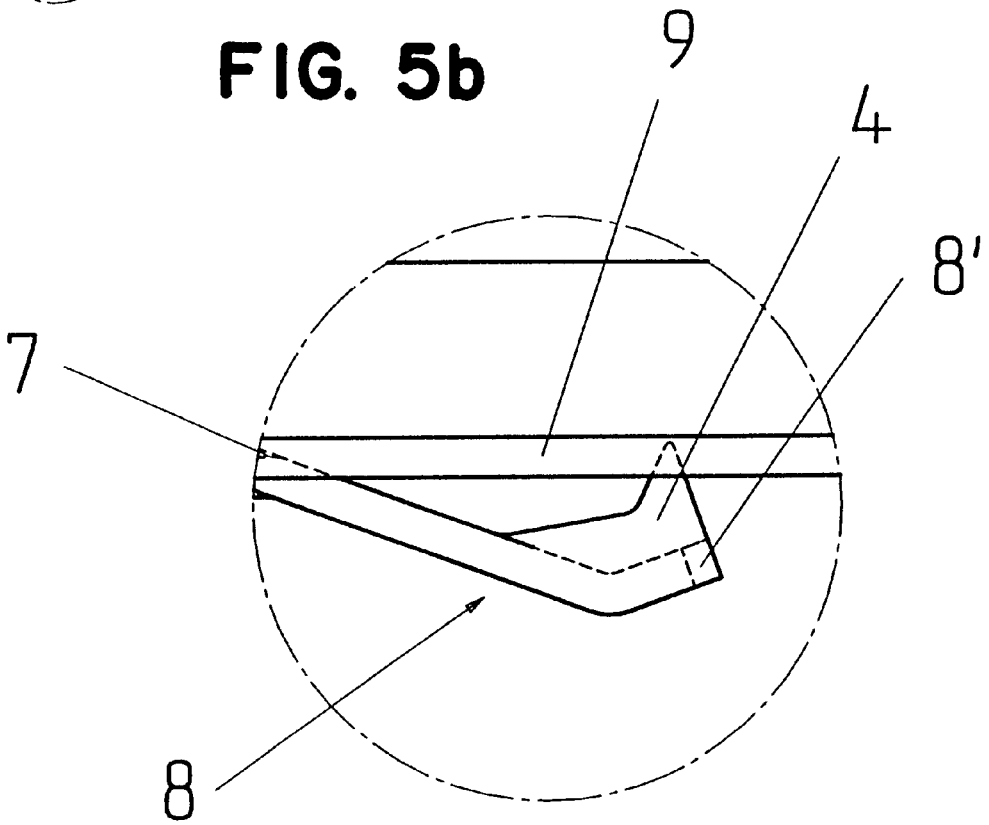
Figure 6A:
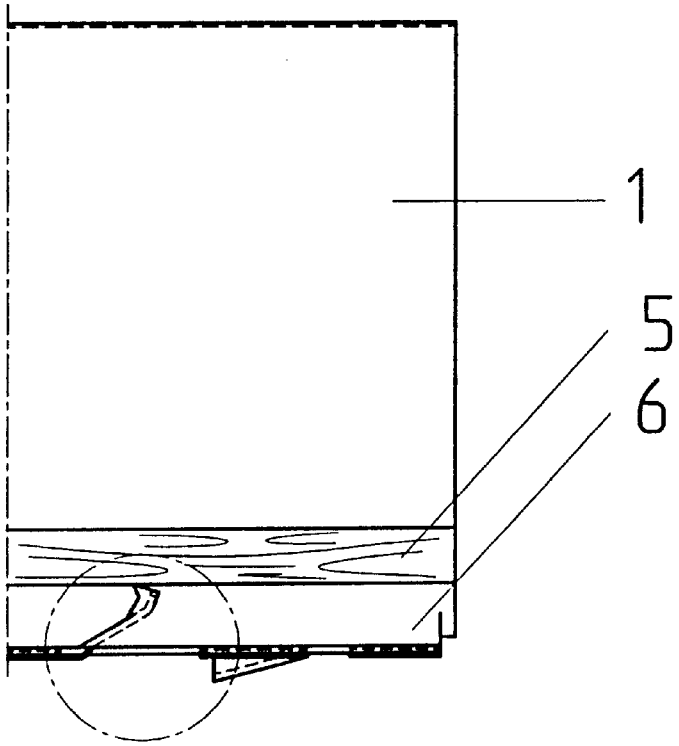
FIGS. 6*a* and 6*b* are a side view of the front end of the drawer frame with an anchored bottom board, the bottom board having a groove, and an enlarged detail thereof, respectively.
Figure 6B:
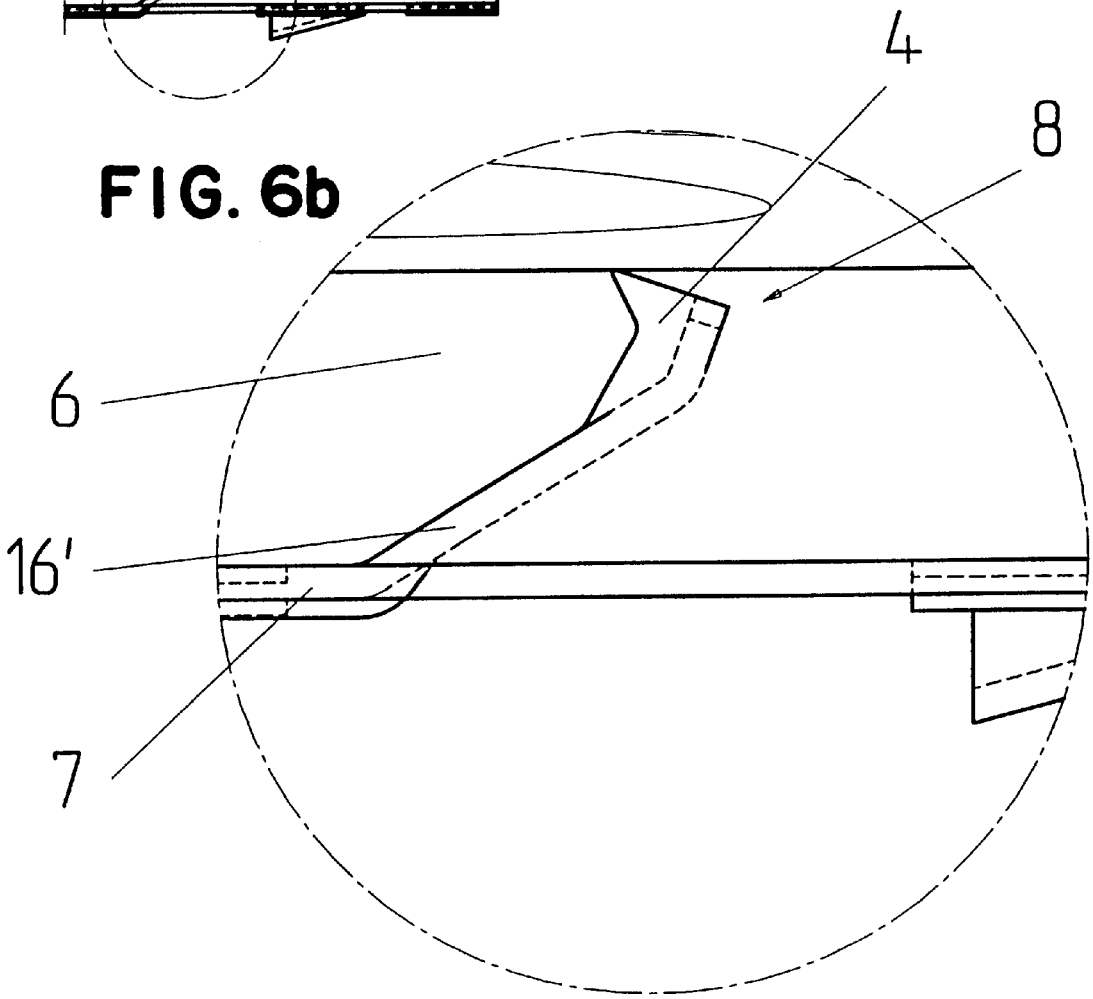

DESCRIPTION OF THE PREFERRED EMBODIMENTS as can be seen in the drawings, within an upper double-walled drawer frame member 1 is hung a lower frame member 3 which has a support web 7 for a bottom board 2, 5 of a wood material or plastic. The pull-out rail (not shown) of a drawer guide assembly is hung into the lower drawer frame member 3. The lower frame member 3 may be designed in one piece, but it may also consist of a plurality of sections distributed over the length of the upper drawer frame member 1.

Tabs 8 oriented in the longitudinal direction of the support web 7 are punched out of the support web 7. The tabs 8 are situated in asymmetric slots 9, that is to say are bent out of the latter. The slots 9 are circumferentially closed. Each tab 8 has at one side of the free end thereof an upwardly directed claw 4 likewise oriented in the longitudinal direction of the support web 7 and of the drawer frame. Each tab 8, adjacent the free end thereof, has a bend 14 defining an angled portion oriented perpendicularly to the claw 4. The front or free end of claw 4 has a relatively steep, short edge 10, and the rear portion of claw 4 has a relatively long edge 11. In the illustrated embodiment, the front edge 10 is oriented perpendicularly to the angled portion of the tab 8 located forwardly of the bend 14. At the side of tab 8 opposite the claw 4 are teeth 12, 13.

Further, the support web 7 is provided with a longitudinally extending channel 15 which is interrupted by the slots 9 and the tabs 8.

Before the mounting of the drawer bottom 2, 5, the tabs 8 having the claws 4 are situated beneath the support web 7, i.e. they are bent downwardly out of the support web 7. When the bottom board 2, 5 has been placed onto the support web 7, the tabs 8 are pressed toward the bottom board 2, 5. If a bottom board 2 without grooves is used, the claws 4 and possibly the front region of the tabs 8 are pressed into the material of the bottom board 2, which is made for example of a particle board. This situation is shown in FIGS. 1*a*, 1*b*, 3*a* and 3*b*. If, as shown in FIGS. 4*a*–6*b*, a bottom board 5 having grooves 6 in its underside is used, the tabs 8 are pressed further into the bottom board 5, whereby the tabs 8 project into the groove 6 and laterally into the material of the bottom board 5. The claws 4 are pressed into a side wall 19 of the groove 6 and are engaged therein. The anchoring of the bottom board 5 to the drawer frame, that is to say to the support web 7 of the drawer frame, is improved in this case by the teeth 12, 13 projecting laterally into an opposite side wall of the groove 6. The tab 8 has a wider region 16 which, on both sides of the groove 6, is likewise pressed into the wood material of the bottom board 5. Shoulders 16' of the widened region 16 press the bottom board 5 against a covering lip 18 of the drawer frame, that is to say of the upper drawer frame member 1, so that no gap is visible in the drawer between the bottom board 5 and the drawer frame.

Figure 7B:
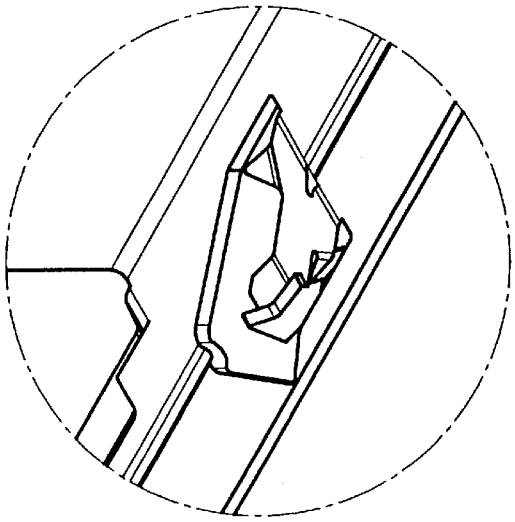
FIGS. 7*a*–7*c* are a perspective view of a drawer frame according to a further embodiment and two enlarged details thereof, respectively.
Figure 7A:
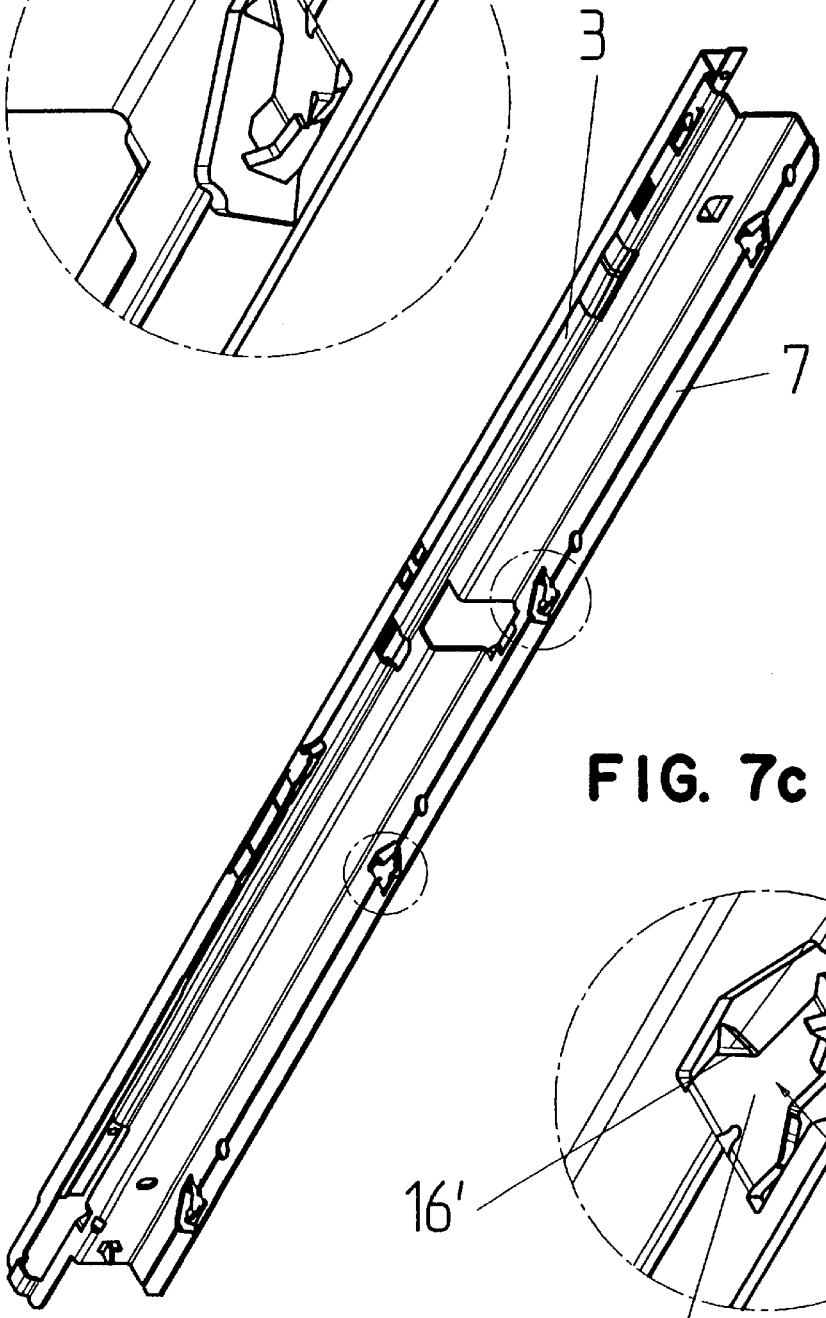
Figure 7C:
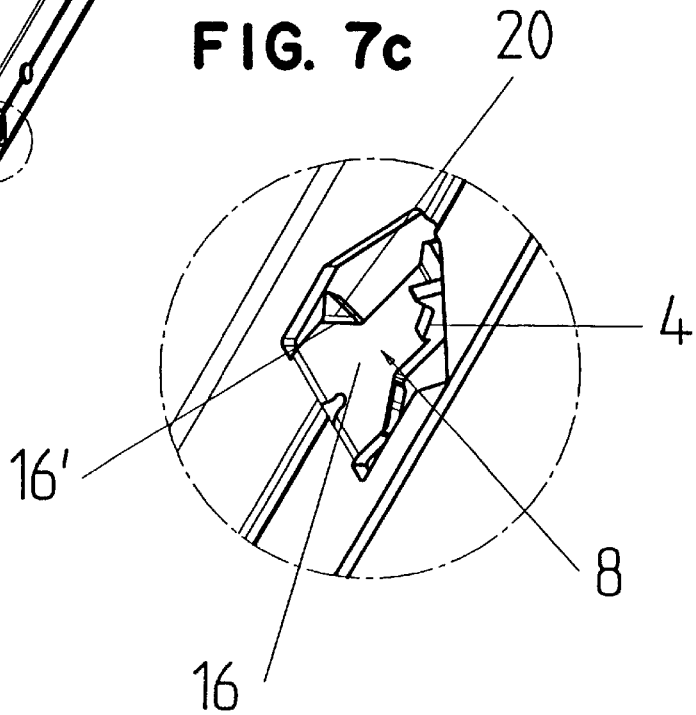
Figure 8:
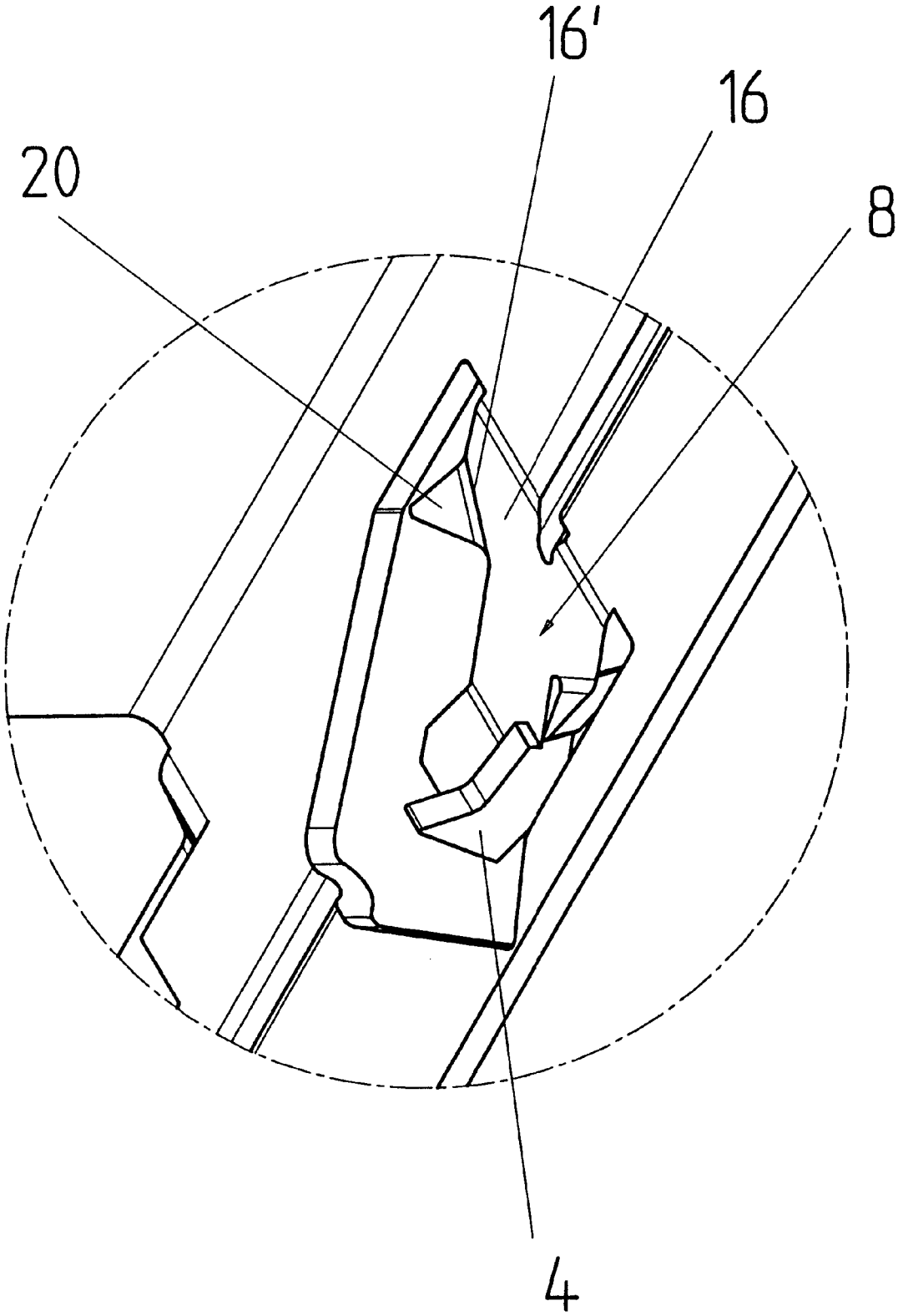
FIG. 8 is an enlarged perspective view of a detail of a tab according to the embodiments of FIGS. 7*a*–7*c;*
Figure 9:
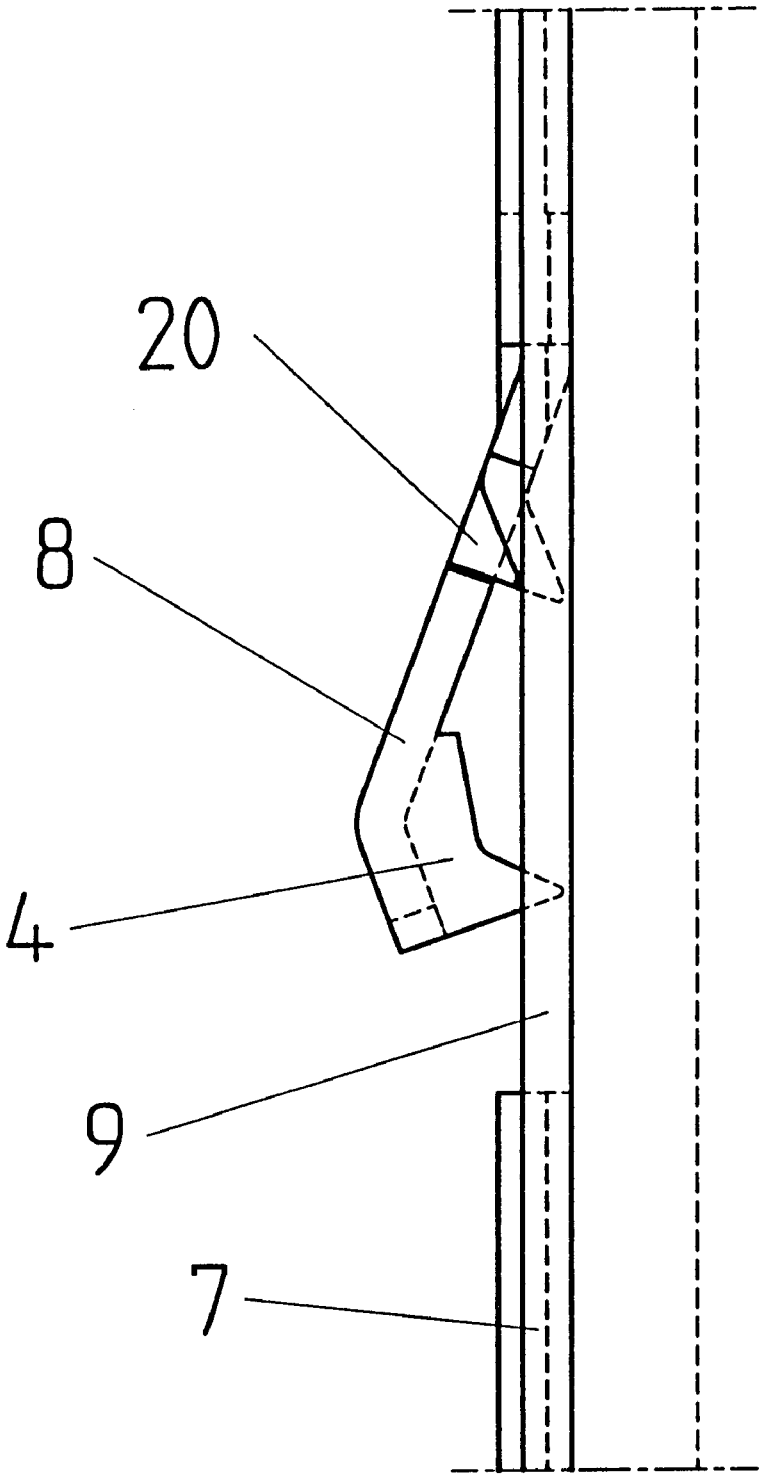
FIG. 9 is a side view of a drawer frame in the region of a tab.
Figure 10B:
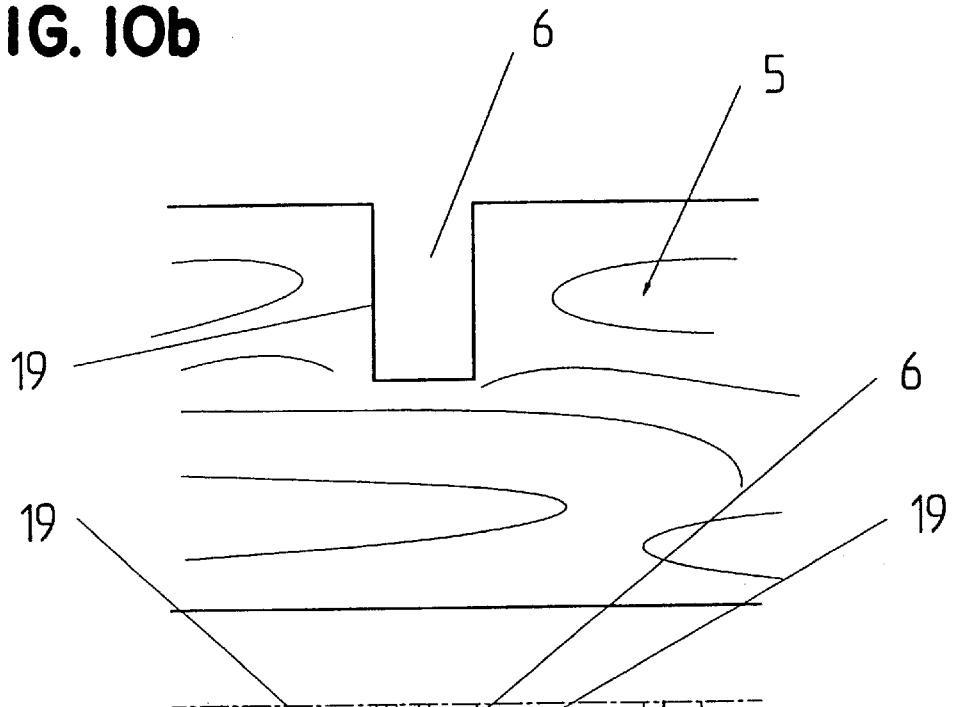
FIGS. 10*a* and 10*b* respectively are a plan view of a drawer frame in the region of the tab and an elevation view of the bottom board in the region of the groove.
Figure 10A:
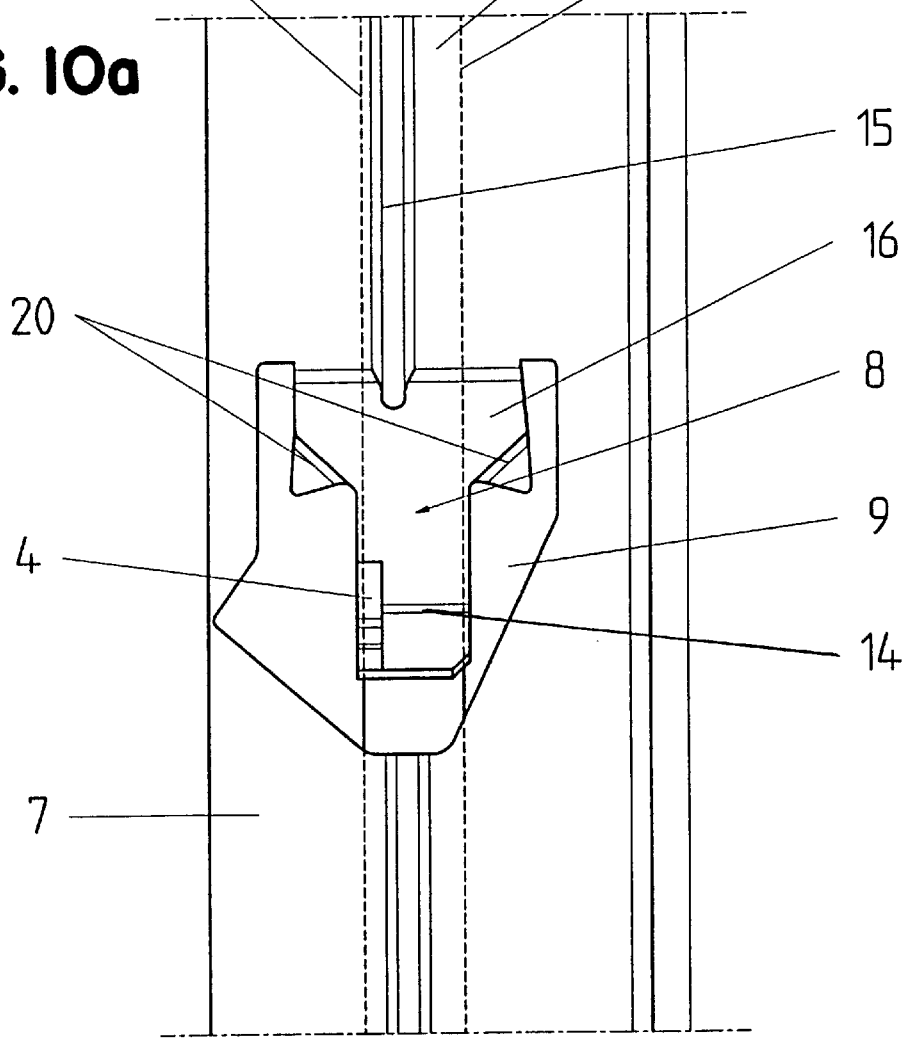
Figure 11:
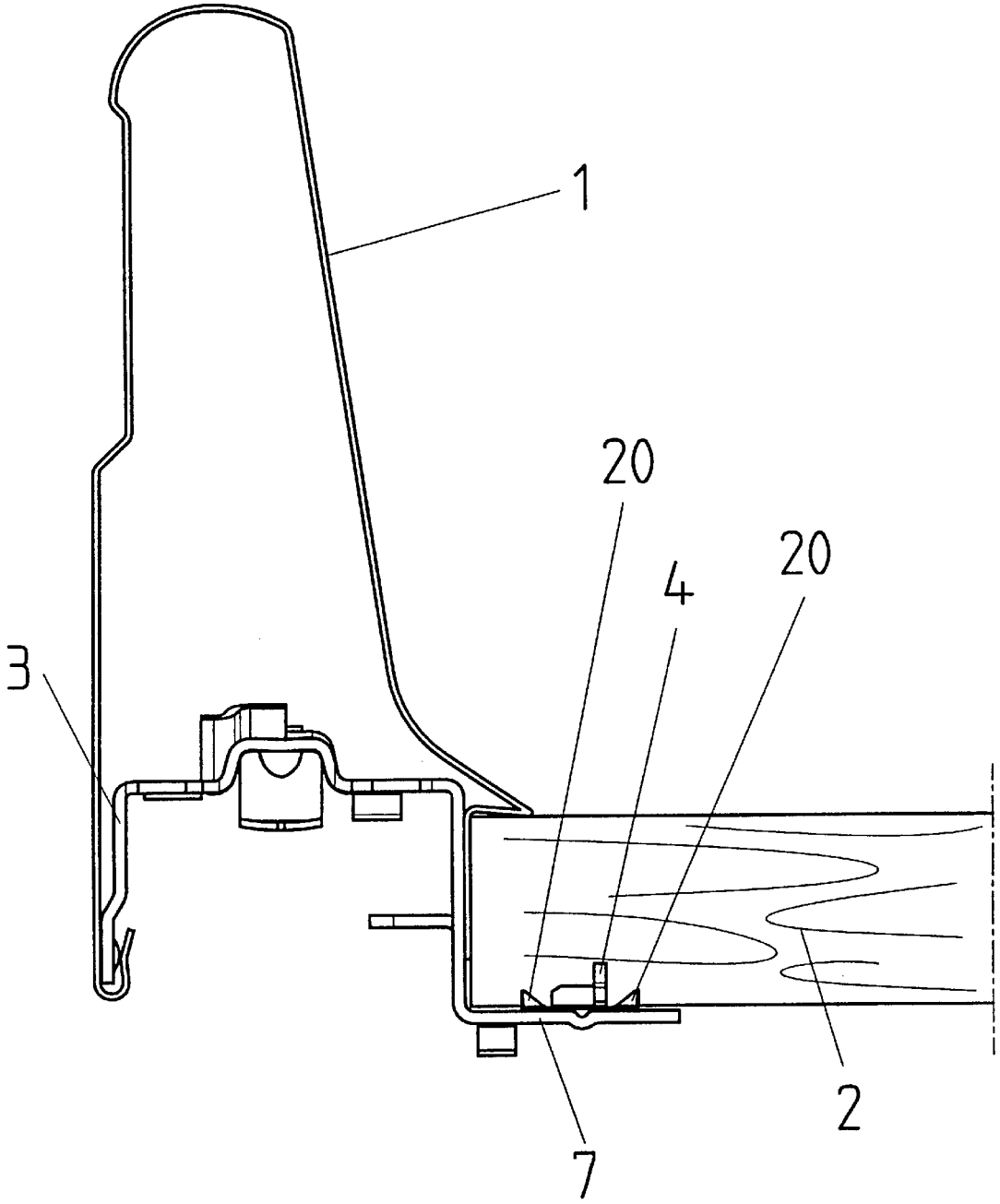
FIG. 11 is a front view of a drawer frame according to the embodiment of FIGS. 7*a*–10*b*.

In the embodiment according to FIGS. 7*a* to 11, claws 20 are formed on the shoulders 16' of the wider regions 16 of the tabs 8. The claws 20 are oriented obliquely or transversely to the direction of orientation of the tabs and when the bottom board 2, 5 is anchored project into the wood material of the bottom board 2, 5. Preferably, as shown in FIGS. 7*a*–7*c*, successive or longitudinally adjacent tabs 8 are oriented in opposite directions. The claws 20 prevent the bottom boards 2, 5 from being unintentionally displaced from the support webs, for example when the drawer is pushed into the carcass of an article of furniture with too much force.

In the vicinity of each of the tabs 8, a depression 17 or the like is pressed out of the support web 7 and projects downwardly (in the working position of the drawer) from the support web 7. In the illustrated embodiment, the depression 17 corresponds to a section of a cone. The depressions 17 serve as spacers for the drawer, so that when the drawer is set down on a table top, to clean it for example, portions of the tabs 8 projecting downwardly out of the support web 7 do not scratch the table top.

We claim the following:

1. A metal drawer frame comprising:

a longitudinal horizontal support web for supporting a bottom board;

a plurality of tabs punched out of said support web, each said tab having a first end integral with said support web, a free second end, and opposite sides extending in the longitudinal direction of said support web from said first end to said second end; and said tabs having extending upwardly therefrom respective claws, each said tab and the respective said claw extending in respective different planes, each said claw being situated along a said side of a respective said tab which is oriented in said longitudinal direction.

2. A drawer frame as claimed in claim 1, wherein each said tab has extending upwardly from said side thereof a respective said claw.

3. A drawer frame as claimed in claim 1, wherein each said claw extends upwardly from a said side of respective said claw.

4. A drawer frame as claimed in claim 3, wherein each said tab has extending therefrom only a single said claw.

5. A drawer frame as claimed in claim 3, wherein each said tab has extending from a said side thereof opposite said claw at least one laterally protruding tooth.

6. A drawer frame as claimed in claim 1, wherein each said tab is bent from an asymmetrical slot in said support web.

7. A drawer frame as claimed in claim 1, wherein each said tab has, adjacent said claw, a bend extending perpendicular to said claw.

8. A drawer frame as claimed in claim 1, wherein said support web has a longitudinally extending channel interrupted by said tabs.

9. A drawer frame as claimed in claim 1, wherein each said claw has a front, relatively short edge and a rear relatively long edge.

10. A drawer frame as claimed in claim 9, wherein said front edge extends perpendicularly to said tab.

11. A drawer frame as claimed in claim 1, wherein each said tab has a wider region with shoulders having further claws.

12. A drawer frame as claimed in claim 11, wherein said shoulders are located at said opposite sides of each said tab.

13. A drawer frame as claimed in claim 11, wherein said further claws are oriented obliquely to said longitudinal direction.

14. A drawer frame as claimed in claim 11, wherein said further claws are oriented transversely to said longitudinal direction.

15. A metal drawer frame comprising:

a longitudinal horizontal support web for supporting a bottom board;

a plurality of tabs punched out of said support web, each said tab having a first end integral with said support web, a free second end, and opposite sides extending in the longitudinal direction of said support web from said first end to said second end, and each said tab having at said first end a wider region with shoulders; and each said tab having claws extending upwardly from said second end thereof and from said shoulders thereof.

16. A drawer comprising:

two metal drawer frames, each said drawer frame including:

a longitudinal horizontal support web for supporting a bottom board;

a plurality of tabs punched out of said support web, each said tab having a first end integral with said support web, a free second end, and opposite sides extending in the longitudinal direction of said support web from said first end to said second end; and said tabs having extending upwardly therefrom respective claws oriented in said longitudinal direction;

a bottom board having an underside having two grooves therein; and said bottom board being supported on said horizontal webs of said drawer frames, with said tabs of said drawer frames extending into respective said grooves of said bottom board and with said claws of said tabs engaged in side walls of said respective grooves.

* * * * *